US006450078B1

(12) United States Patent
Frank et al.

(10) Patent No.: US 6,450,078 B1
(45) Date of Patent: Sep. 17, 2002

(54) THERMAL GASKETS AND METHOD AND APPARATUS FOR PRODUCING THE SAME

(75) Inventors: Mary H. Frank, Cookeville; Gerald M. Ragland, Pleasant Shade; Zhong-Huai Zhang, Mt. Juliet, all of TN (US)

(73) Assignee: Federal-Mogul Systems Protection Group, Inc., Exton, PA (US)

( * ) Notice: Subject to any disclaimer, the term of this patent is extended or adjusted under 35 U.S.C. 154(b) by 0 days.

(21) Appl. No.: 09/702,207

(22) Filed: Oct. 31, 2000

(51) Int. Cl.[7] ..... D04C 3/14
(52) U.S. Cl. ..... 87/55; 87/54; 87/56; 87/57
(58) Field of Search ..... 87/55, 13, 54, 87/56, 57

(56) References Cited

U.S. PATENT DOCUMENTS 621,099 A 3/1899 Kirberg
1,499,830 A * 7/1924 Krissiep ..... 87/37
1,742,359 A 1/1930 Krissiep
2,337,977 A 12/1943 Davis
2,831,390 A * 4/1958 Leimbach ..... 87/61
3,408,893 A 11/1968 Singh

* cited by examiner

*Primary Examiner*—Rodney M. Lindsey
*Assistant Examiner*—James G Smith

(57) ABSTRACT

Braider carriers for multiple yarn packages include separate supports for separate packages and separate guides for the yarns from each package. Insulating tubular gaskets having low porosity and comprised of an insulating yarn and wire are manufactured using the carriers. A circular braider used in the manufacture of the gaskets is loaded with a group of carriers each carrying a single yarn package of insulating yarn. The multiple package carriers, each of which is selectively positioned between carriers of the first group, supply insulating yarn and wire.

5 Claims, 3 Drawing Sheets

THERMAL GASKETS AND METHOD AND APPARATUS FOR PRODUCING THE SAME

FIELD OF THE INVENTION

This invention relates to braided tubular objects and more especially to braided tubular gaskets exhibiting excellent thermal performance. The invention also relates to apparatus and method for the production of such articles.

BACKGROUND OF THE INVENTION

Braided tubular gaskets incorporating insulating yarns and resilient wire have been in wide spread use for many years. Oven door gaskets are a particular application for such tubular articles. A particularly effective tubular gasket of the kind referred to is manufactured by Federal-Mogul Systems Protection Group, Inc. under the trademark PYROSEAL. These gaskets comprise an inner support layer of knitted wire which resiliently supports an outer layer of relatively densely braided glass fiber yarn or other yarn characterized by good thermal performance. In such gaskets, the relatively densely braided thermal yarn effectively insulates the oven door and the wire resiliently supports the yarn so that a very effective seal is provided.

More recently, tubular oven gaskets have been produced in which the wire and the glass are interbraided. In these gaskets, the proportion of wire to glass can be adjusted to provide the requisite resilience combined with thermal performance. The interbraiding of the wire and the glass eliminates a processing step and yields a satisfactory gasket for many purposes at a substantial savings in cost. As in the PYROSEAL® gasket, wire provides a support matrix within which the spaced attachment protrusions are held in place.

One problem with gaskets of the kind just mentioned is that the same thermal performance achievable with the PYROSEAL® gasket has not been found to be practical due to limitations in the braiding process as carried out with conventional circular braiding equipment. Since the relatively fine diameter wire used in such gaskets has a tendency to cut the glass during the braiding process, it has been found necessary to feed the yarn and the glass from separate bobbins on separate carriers. In a conventional circular braider, when the wire occupies a separate carrier, in the tubular gasket produced, insulating yarn is replaced by small diameter wire. When one inspects a gasket made by this method of interbraiding, the points where wires cross over one another create relative large openings in the surface of the gasket which are destructive of good thermal protection. Even if the amount of wire used in the gasket is limited, thermal performance is sacrificed.

SUMMARY AND OBJECTS OF THE INVENTION

An objective of the invention is the braiding of tubular articles comprised of yarns of different properties, particularly yarns of different abrasive properties in a manner which reduces porosity and the tendency of the more abrasive yarn to abraid and break the less abrasive yarn during the braiding process. The invention is particularly concerned with the production of tubular gaskets comprised of interbraided wire and glass or other insulating yarn having thermal performance equivalent to gaskets comprising a knitted wire core with a braided cover layer. This objective achieved by the use of yarn carriers, each supporting multiple superimposed yarn packages. The carriers of the present invention include a yarn support spindle sized to receive a bobbin of relatively large diameter yarn of standard size. A second support spindle is provided to receive a bobbin of relatively fine diameter material, such as flexible resilient monofilament wire having the same length as the length of the yarn on the first bobbin. Preferably, the second bobbin is oriented transversely to the axis of rotation of the first bobbin, and the spindle upon which it is supported is short relatively to the length of the spindle for the first bobbin. Independent yarn tensioning means are provided for the material fed from the two bobbins. The yarns are simultaneously delivered to the fell through separate guides which hold them in spaced apart relationship so that the relatively thin, hard material cannot abraid the fragile fibers of the insulating material during the braiding process.

Through the use of this equipment, the production advantage of producing gaskets having interbraided wire or other fine diameter filamentary material along with relatively large diameter fibrous yarns is achieved without sacrificing thermal performance. The tubular articles so produced are relatively less porous since every braider carrier delivers at least one relatively large diameter yarn to the finished article.

Yet another advantage of the invention arises due to the compact nature of the stacked carrier. The yarn packages mounted on the stacked carrier may be of the same capacity as the yarn packages located on the single carriers and may have the same capacity as the carriers of the fine diameter material without occupying more space of the braider deck. An advantage of this is that neither carrier of the double carriers will prematurely run out of yarn, thereby avoiding premature stoppage of the braider.

A further aspect of the invention is a method of braiding an insulating sleeve, such as a thermal gasket, comprising loading the deck of a circular braider with a first set of yarn carriers, each carrying a single yarn package of an insulating yarn and establishing a first set of yarn positions occupied by the insulating yarn. The method further comprises selectively positioning a second set of yarn carriers on the braider deck, each carrying a yarn package of insulating yarn and a second package of resilient wire, thereby establishing a second set of yarn positions, the second set of yarn positions being occupied by the insulating yarn and the wire. The method includes the step of interbraiding the yarn of the first set of yarn carriers with the yarn and wire of the second set of yarn carriers and further comprises separately and simultaneously guiding the yarn and the wire from the yarn and wire packages of the carriers of the second set of carriers. Still further, the method preferably comprises axially orienting the package of insulating yarn on a carrier of the second set transversely of the axis of the wire package on the carrier.

In yet another of its aspects, the invention comprises the manufacture of a tubular gasket of insulating yarn interbraided with resilient wire, wherein the sleeve has insulating yarn and wire combined at selected yarn positions and insulating yarn exclusively at the remaining yarn positions. Preferably, the yarn and wire are densely packed so as to restrict openings for the passage of air through the braided structure. An insulating tubular gasket according to the invention preferably comprises insulating yarn having a denier of between about 1800 to about 8000 and wire in monofilament form having a diameter of between about 0.004" and about 0.007".

BRIEF DESCRIPTION OF THE DRAWINGS

Turning to the drawings wherein the preferred embodiments of the invention are illustrated.

DETAILED DESCRIPTION OF THE PREFERRED EMBODIMENT

Figure 1:
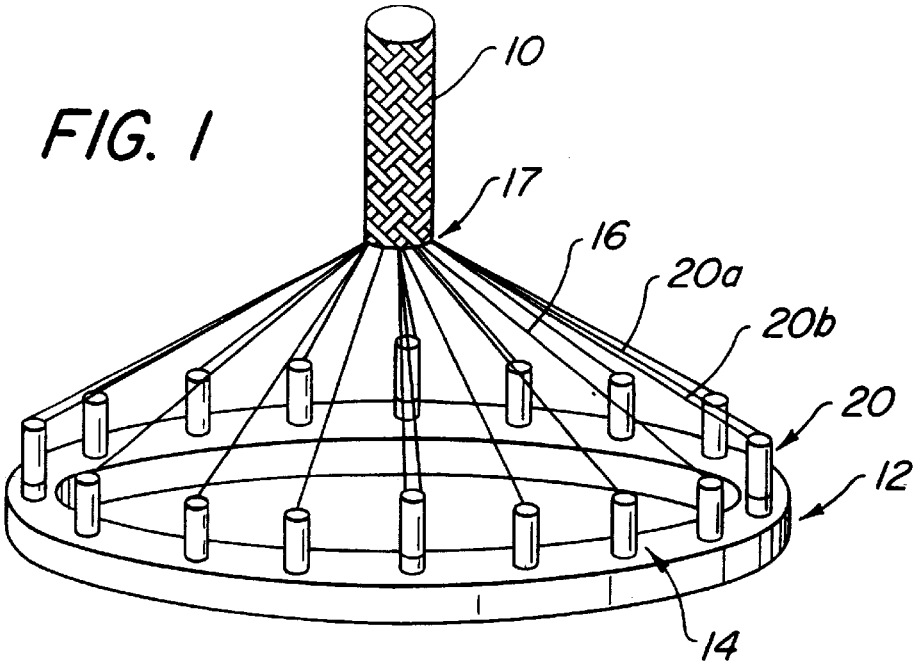
FIG. 1 illustrates in schematic form a braider incorporating the principles of the invention.
Figure 3:
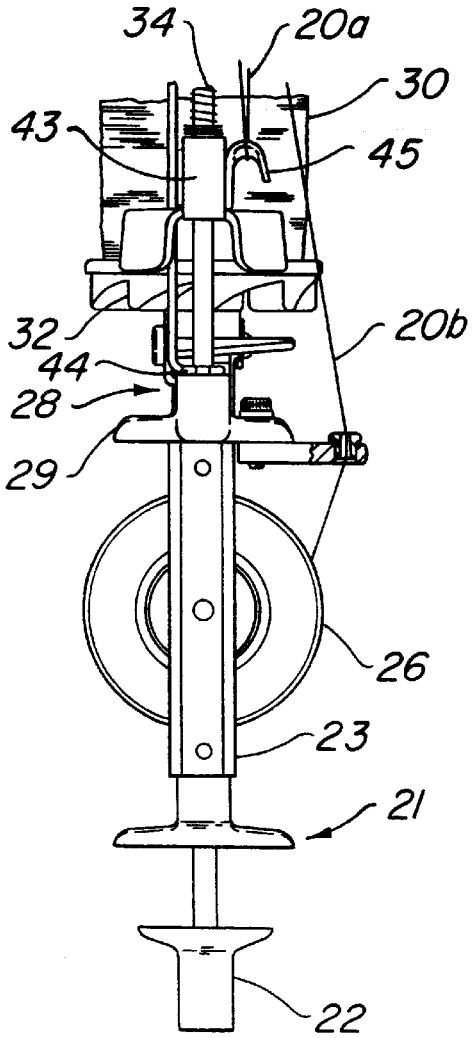
FIG. 3 is a fragmentary side elevational view taken at 90° with respect to FIG. 1, illustrating a portion of the braider carrier of FIG. 2.
Figure 2:
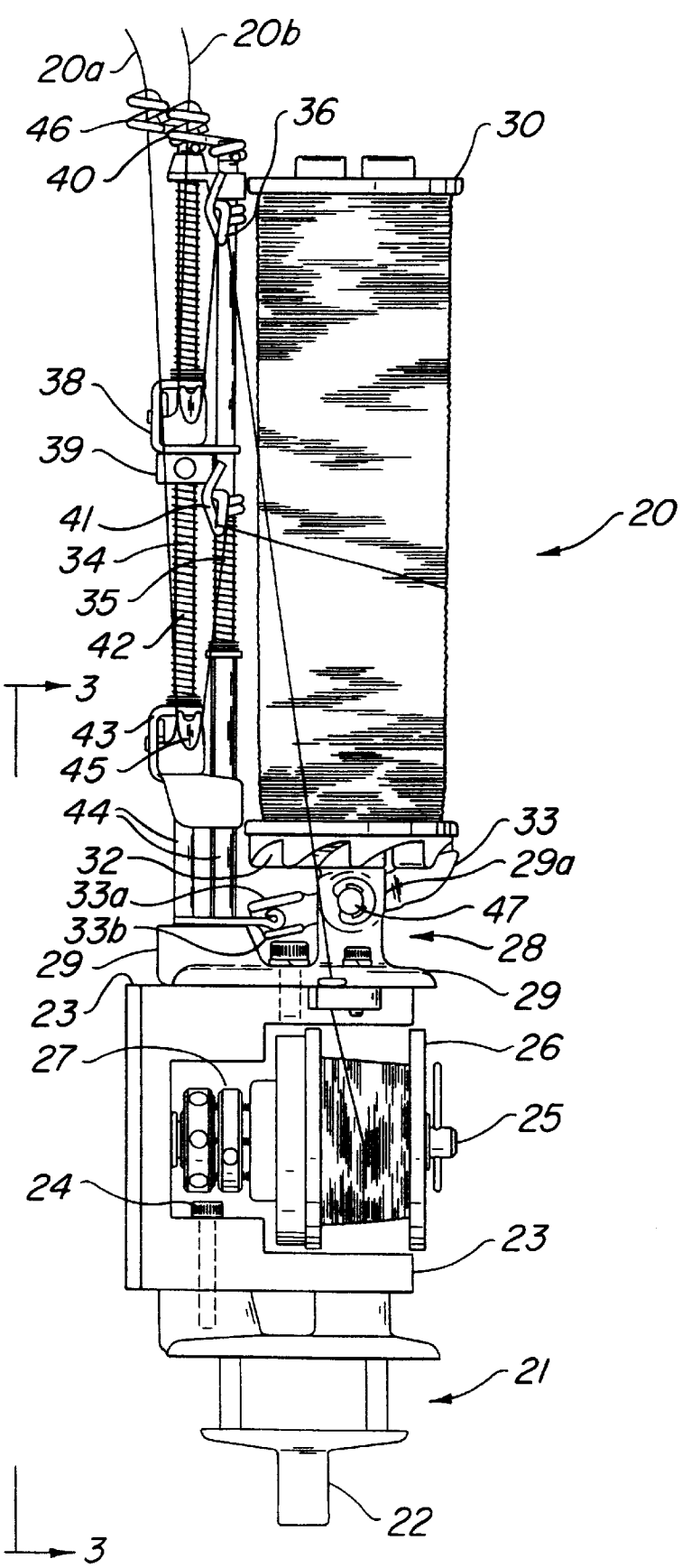
FIG. 2 is a side elevational view of a preferred form of braider carrier utilized in the braider of FIG. 1.
Figure 4:
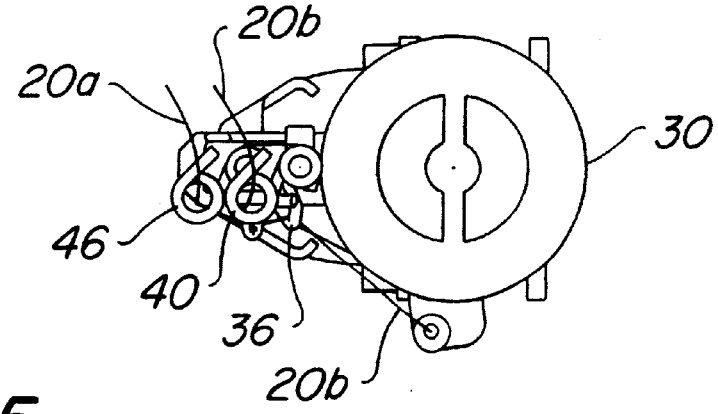
FIG. 4 is a top view of the braider carrier of FIG. 2.

With reference first to FIG. 1, a schematic view of a circular braider is disclosed for use in manufacture of a tubular article 10. The braider includes a braider deck 12 on which a multiplicity of carriers 14 of conventional construction are supported. In the manufacture of a tubular gasket, each carrier preferably carries a single bobbin or package of an insulating yarn 16 comprised typically of glass fiber for delivery to the fell 17. Carriers 20, as shown in FIGS. 2–4 and described below, are positioned between groups of carriers 14. Each carrier 20 separately rotatably supports plural yarn packages. In the illustrative embodiment, the carriers 20 preferably are loaded with a bobbin or package of an insulating yarn 20*a* and a bobbin or package of a wire 20*b*. The bobbins for the insulating are preferably of the same kind and capacity as the bobbins carried by carrier 14. The carriers 20 are provided at those braid portions where it is desired to integrate a wire into the braid. In the manufacture of a preferred form of gasket, every fourth carrier is a double-deck carrier of the kind illustrated in FIGS. 2–4.

The preferred form of braider carrier, shown in FIGS. 2–4, generally comprises a raceway engaging base 21 having a depending track follower 22. As will be understood by those in the art, the movement of all of the carriers on the deck is provided by means of rotating horn gears which engage the followers to propel the carriers around the track in a serpentine or maypole fashion so that the yarns interlace as the carriers pass each other. The number of carriers may vary substantially, a typical braider for carrying out the invention having between about 48 to 96 carriers of which about 6 carriers to about 24 carriers would be of the type illustrated in FIG. 2–4, the remaining carriers supporting a single yarn package.

As shown in FIGS. 2 and 3, a first spindle support 23 for rotatable support of a first yarn package is secured to the upper surface of the raceway engaging base 21 by means of fasteners, such as a machine bolt 24. The first spindle support carries a spindle 25 which is threadedly secured to the support and extends transversely of the carrier. Spindle 25 preferably rotatably supports a wire bobbin or package 26. An adjustable brake 27 of known construction provides the requisite amount of resistance to rotation of the package 26.

A second spindle support 28 comprises a base 29 bolted or otherwise secured to the upper surface of the first spindle support 23. The base has an upwardly extending pedestal 29*a* which rotatably supports a bobbin 30. The bobbin is of conventional construction, preferably has the same capacity as the bobbins on carrier 20 and includes a base 31 having downwardly projecting rachet teeth 32. A pawl 33 is pivotally mounted on the pedestal and is spring loaded, as will be described hereinafter, into a position in which rotation of the bobbin is blocked.

FIGS. 2–4 also illustrate a preferred form of tensioning means for controlling the payoff of the yarns from the two bobbins carried on each of the carriers 20. According to FIG. 2, a pair of rigid upright guide rods 34 and 35 are mounted on the base 29 of second spindle support 28. A yarn guide 36 fixed to the top of rod 35 guides the wire upwardly from first bobbin 26. A movable yarn guide 38 is slidably mounted on rod 34 and urged downwardly against fixed stop 39. The wire is fed around a guide finger of movable yarn guide 38 and then relatively upwardly through an eyelet guide 40 fixed to the upper end of rod 34. The spring 37 and the movable guide 38 provide a take-up means which maintains a set degree of tension on the wire from the first bobbin.

The tensioning means for the yarn from bobbin 30 comprises a fixed guide 41 through which the yarn from the upper bobbin is fed. A spring 42 mounted on rod 34 urges a movable guide 43 downwardly. The movable guide is connected to a slidable foot 44 which rests on the upper surface of upper spindle support 28. The end of the foot 44 rests within a pair of bent over flanges 33*a* and 33*b* on pawl 33. As best seen in FIG. 2, yarn from bobbin 30 is fed from guide 41 around a guide finger 45 fixed on movable guide 43 and follows a path upwardly through a separate eyelet guide 46. Tension on the yarn lifts the finger 45, causing foot 44 to be raised. As the foot is raised, pawl 33 rotates about its mounting axis 47 to release bobbin 30 for rotation, resulting in a payoff of yarn from the bobbin. As the bobbin rotates, the tension on the yarn decreases allowing foot 44 to drop under the urging of spring 42. This causes pawl 33 to be raised so that it moves back between the next set of rachet teeth 32.

In the manufacture of a typical gasket according to the invention, a stainless steel, full-hard wire having a diameter of between about 0.004" and about 0.007" and an insulating yarn having a denier of about 1800 to about 8000 is preferably employed. Insulating yarns usable in making gaskets according to the invention are glass, aramed and ceramic, a preferred yarn being a continuous glass fiber yarn of 3600 denier as manufactured by PPG Industries of Pittsburgh, Pa., the yarn being identified by number 37 -1/3 ECG. A sleeve using the above materials is manufactured on a circular braider having 72 carriers with every sixth carrier being a double-deck carrier. The wire used is 0.006" diameter stainless steel type 304 wire.

Figure 5:
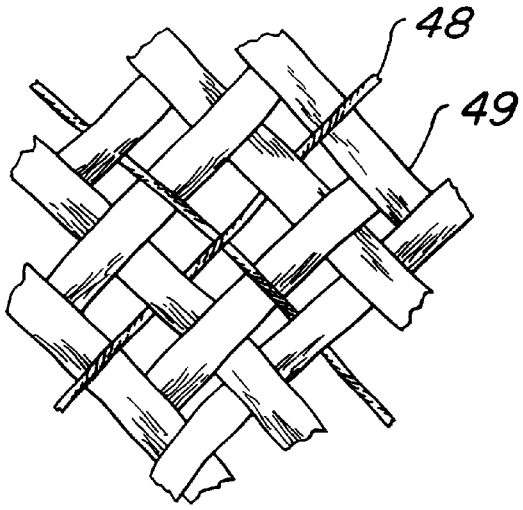
FIG. 5 (PRIOR ART)
FIG. 5 is a schematic view of a portion of a prior art form of gasket.
Figure 6:
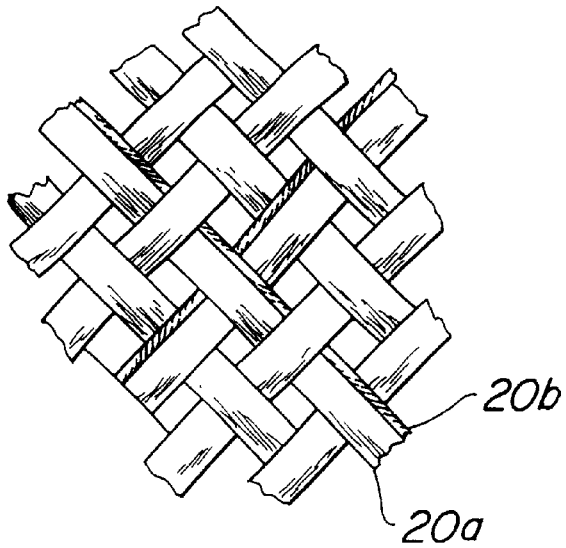
FIG. 6 is a schematic view of a portion of a gasket incorporating the teachings of the present invention.

FIG. 5 is a fragmentary view illustrating a prior art gasket and the porosity that occurs owing to the replacement of insulating yarn with wire at selected braid positions. An inspection of FIG. 6 will show that in contrast to the prior art sleeve of FIG. 5, wherein the wire is shown at 48 and insulating yarn at 49, the simultaneous introduction of the insulating yarn with wire allows for a substantial decrease in porosity which yields increased thermal performance. Since the yarn and wire are separately fed to the fell, the tendency of the insulating yarn to be cut by the fine diameter wire during the braiding operation is substantially reduced. Gaskets formed according to the invention are less expensive and faster to manufacture than the prior art braided gaskets of equivalent thermal performance.

What is claimed is:

1. A braider carrier for multiple yarn packages, said carrier comprising:

a raceway engaging base, support means on said base for rotating support of a multiplicity of superimposed yarn packages;

a first elongated spindle having a long axis projecting upwardly from the path of travel of said carrier for support of a first yarn package and a second spindle disposed between the first yarn spindle and the base for support of a second yarn package, said second spindle projecting transversely of said path of travel of said carrier;

a separate thread guide for the yarn from each of said yarn packages; and tension control means for separately controlling the tension of the yarn from each of said packages.

2. A braider carrier according to claim 1, wherein said second spindle-is shorter than said first spindle.

3. A braider carrier according to claim 2, wherein said first spindle accommodates an insulating yarn package and said second spindle accommodates a monofilament wire package and wherein said wire has a diameter smaller than the yarn.

4. A braider carrier according to claim 2, wherein the length of the wire in the wire package is at least as long as the length of yarn in the yarn package.

5. A braider carrier according to claim 1, wherein said second spindle is positioned intermediate said first spindle and said base.

* * * * *